US007770263B2

(12) United States Patent
Thomson et al.

(10) Patent No.: US 7,770,263 B2
(45) Date of Patent: Aug. 10, 2010

(54) NON-METALLIC DEVICES FOR HOLDING PAPER, CARDS, AND WALLETS

(75) Inventors: Chip E. Thomson, Austin, TX (US); Glen E. Clifton, Austin, TX (US); Timothy Uys, Austin, TX (US)

(73) Assignee: Beza, L.P., Austin, TX (US)

( * ) Notice: Subject to any disclaimer, the term of this patent is extended or adjusted under 35 U.S.C. 154(b) by 135 days.

(21) Appl. No.: 11/283,403

(22) Filed: Nov. 18, 2005

(65) Prior Publication Data

US 2006/0137149 A1 Jun. 29, 2006

Related U.S. Application Data

(60) Provisional application No. 60/629,280, filed on Nov. 18, 2004.

(51) Int. Cl.
*B42F 1/10* (2006.01)

(52) U.S. Cl. ..... 24/67.7; 24/558

(58) Field of Classification Search ..... 24/67 R–67 P, 24/553, 554, 557, 558, 565, DIG. 8, DIG. 9
See application file for complete search history.

(56) References Cited

U.S. PATENT DOCUMENTS

| | | | | | |
|---|---|---|---|---|---|
| 475,259 | A | * | 5/1892 | Turck | 24/67.5 |
| 475,425 | A | | 5/1892 | Vawter et al. | |
| 1,133,388 | A | | 3/1915 | Merrill | |
| 1,139,627 | A | | 5/1915 | Baltzley | 24/565 |
| 1,150,073 | A | * | 8/1915 | Spengler | 24/565 |
| 1,435,917 | A | | 11/1922 | Ensign | |
| 2,125,768 | A | | 8/1938 | Christensen et al. | 40/23 |
| 4,129,237 | A | | 12/1978 | Grinder | 224/5 |
| 4,286,358 | A | | 9/1981 | Levin | 24/67 R |
| 4,332,060 | A | | 6/1982 | Sato | 24/67.9 |
| 4,402,530 | A | | 9/1983 | Daguerre | 281/45 |
| 4,532,680 | A | | 8/1985 | Hashimoto | 24/67 R |
| D283,844 | S | | 5/1986 | Saad et al. | D2/430 |
| 4,675,953 | A | | 6/1987 | Higgs | 24/499 |
| 4,735,438 | A | | 4/1988 | Demarest, Jr. | 281/42 |
| 4,761,862 | A | | 8/1988 | Hiromori | 24/67.9 |
| 4,802,263 | A | * | 2/1989 | Lorber | 24/67.5 |
| D321,209 | S | | 10/1991 | Hiromori | D19/65 |
| D321,210 | S | | 10/1991 | Hiromori | D19/65 |
| 5,079,808 | A | | 1/1992 | Brown | 24/67.7 |
| 5,080,223 | A | | 1/1992 | Mitsuyama | 206/39.5 |
| 5,249,336 | A | | 10/1993 | Miller | 24/67.5 |
| 5,249,437 | A | | 10/1993 | Cole, Jr. | 63/2 |
| 5,533,236 | A | | 7/1996 | Tseng | 24/67.5 |
| D372,498 | S | | 8/1996 | Sato | D19/65 |
| 5,653,276 | A | | 8/1997 | Niernberger | 150/137 |
| 5,806,147 | A | | 9/1998 | Sato | 24/67.9 |
| 5,896,624 | A | | 4/1999 | Horswell | 24/67.5 |
| 5,950,283 | A | | 9/1999 | Sato | 24/67 |

(Continued)

FOREIGN PATENT DOCUMENTS

| | | |
|---|---|---|
| FR | 2714807 | 7/1995 |

*Primary Examiner*—James R Brittain
(74) *Attorney, Agent, or Firm*—Fulbright & Jaworski L.L.P.

(57) ABSTRACT

Devices for holding paper, cards, and/or wallets. The devices generally have a non-metallic (e.g., plastic) clip to which two non-metallic (e.g., plastic) arms are pivotally coupled. Embodiments of the devices are relatively light-weight and can pass freely through metal detectors.

12 Claims, 21 Drawing Sheets

U.S. PATENT DOCUMENTS

| | | | | |
|---|---|---|---|---|
| 6,327,749 | B1 | 12/2001 | Antinone | 24/67 R |
| 6,374,463 | B1 | 4/2002 | Kaufman | 24/67.5 |
| 6,554,020 | B2 | 4/2003 | Yamaji et al. | 137/341 |
| D479,146 | S | 9/2003 | Manley | D11/78.1 |
| 6,088,889 | A1 | 12/2003 | Schaffer et al. | 604/250 |
| D485,780 | S | 1/2004 | Thomson | D11/78.1 |
| 6,732,419 | B2 | 5/2004 | Davis | 29/450 |
| 6,745,805 | B2 | 6/2004 | Thomson | 150/137 |
| 7,120,970 | B2 | 10/2006 | Thomson et al. | 24/67.5 |
| 2003/0140996 | A1* | 7/2003 | Thomson | 150/138 |
| 2004/0040122 | A1* | 3/2004 | Huang | 24/67.5 |
| 2005/0060923 | A1 | 3/2005 | Ardern | 40/658 |

* cited by examiner

NON-METALLIC DEVICES FOR HOLDING PAPER, CARDS, AND WALLETS

CROSS-REFERENCE(S) TO RELATED APPLICATION(S)

This application claims priority to U.S. Provisional Patent Application Ser. No. 60/629,280 filed Nov. 18, 2004. This provisional application is expressly incorporated by reference.

BACKGROUND OF THE INVENTION

1. Field of the Invention

The present invention relates generally to non-metallic (e.g., plastic) devices that hold paper, cards, and/or a wallet.

2. Description of Related Art

Devices that hold money, whether in the form of paper currency or credit cards, come in a variety of shapes and sizes. Examples of such devices, sometimes referred to as money clips, are found in U.S. Pat. Nos. 6,327,749, 5,249,437, and 4,675,953, and in co-pending U.S. application Ser. No. 10/813,640. Devices known as binder clips, which are typically used in an office setting for keeping documents together, have been used as money clips. This is true of both binder clips without ornamentation of any kind, such as those depicted in U.S. Pat. Nos. 1,150,073 and 1,139,627, and with ornamentation as shown in U.S. Pat. No. 6,327,749. Other binder clips are disclosed in U.S. Pat. Nos. D372,498 and D321,210.

SUMMARY OF THE INVENTION

The present devices are suited to holding paper (such as currency, notes, receipts, business cards or the like), cards (such as credit cards, identification cards or the like), and/or wallets. The present devices may be referred to generically as money clips, although they are well-suited to holding things other than money. The clips and arms of the present devices may be made from a non-metallic material such as plastic (one suitable example of which is polycarbonate), and the non-metallic material may be any desired color. Travelers who use embodiments of the present devices will not need to take the device out of their pocket as they pass through a metal detector (at, for example, an airport). Furthermore, embodiments of the present devices will be relatively light-weight because of their non-metallic components. The present devices may also be used to advertise corporate or other types of logos.

Embodiments of the present devices include a non-metallic (e.g., plastic) clip to which two non-metallic (e.g., plastic) arms are pivotally coupled. Embodiments of the non-metallic clip are biased to a substantially closed position (e.g., a position in which the ends of the clip to which arms may be pivotally coupled are close together or touching) from which they may be opened by pivoting the non-metallic arms back against an outer surface of the non-metallic clip and applying force. As pressure, or force, is applied to the pivoted-back non-metallic arms that are in contact with the non-metallic clip, the ends of the clip (to which the arms have been pivotally coupled) are leveraged open. When the pressure, or force, is removed from the non-metallic arms, the non-metallic clip will return substantially to its original substantially closed position, at least during the initial stage of its useful life. Embodiments of the present clips may also have a ridge or ridges on the outer surface of their arm-retaining ends that help to retain the arms in a given position.

Additional details of these and other embodiments of the present devices are disclosed below.

BRIEF DESCRIPTION OF THE DRAWINGS

The following drawings demonstrate certain aspects of the present devices. They illustrate by way of example and not limitation. The clip and arms of the preferred embodiment of the present devices depicted in the drawings are drawn to scale (in terms of proportions) unless otherwise noted.

DESCRIPTION OF ILLUSTRATIVE EMBODIMENTS

The terms "comprise" (and any form of comprise, such as "comprises" and "comprising"), "have" (and any form of have, such as "has" and "having"), and "include" (and any form of include, such as "includes" and "including") are open-ended linking verbs. Thus, a device "comprising" a non-metallic clip having two ends and a leverage bump; and a non-metallic arm pivotally coupled to each end; where one of the non-metallic arms contacts the leverage bump when the non-metallic clip is completely open, is a device that possesses the recited non-metallic clip and non-metallic arms, but is not limited to possessing only those items. For example, the device may also possess a wallet configured to be held by the non-metallic clip. Likewise, a non-metallic clip "having" two ends and a leverage bump possesses those features, but is not excluded from possessing additional, unrecited features, such as pivot shaft retainers having an outer surface defined at least in part by one or more ridges. A feature (e.g., a ridge) that is configured in a certain manner must be configured in at least that manner, but may also be configured in manners that are not recited.

The terms "a" and "an" mean one or more than one. The term "another" means at least a second or more. The term "substantially" is defined as at least close to (and includes) a given value or state (preferably within 10% of, more preferably within 1% of, and most preferably within 0.1% of). Any dimensions provided in English units may be translated to the corresponding metric unit by rounding to the nearest millimeter.

The preferred embodiment of the present devices shown in the present figures was drawn using a pre-release version of Pro/ENGINEER® Wildfire™ software, production versions of which are commercially available from Parametric Technology Corporation, Needham, Mass. As a result, some of these drawings include many lines (some of them light) that are known in the art as "tangent" lines. Those of skill in the art will understand that not all of the tangent lines shown represent a "hard" change of angle. Instead, they may show where a rounded section meets a flat, or straight, section. Furthermore, some features of the preferred embodiment have not been labeled in all of the drawings, so that the drawings are not unnecessarily cluttered.

A. A Preferred Embodiment

Figure 20:
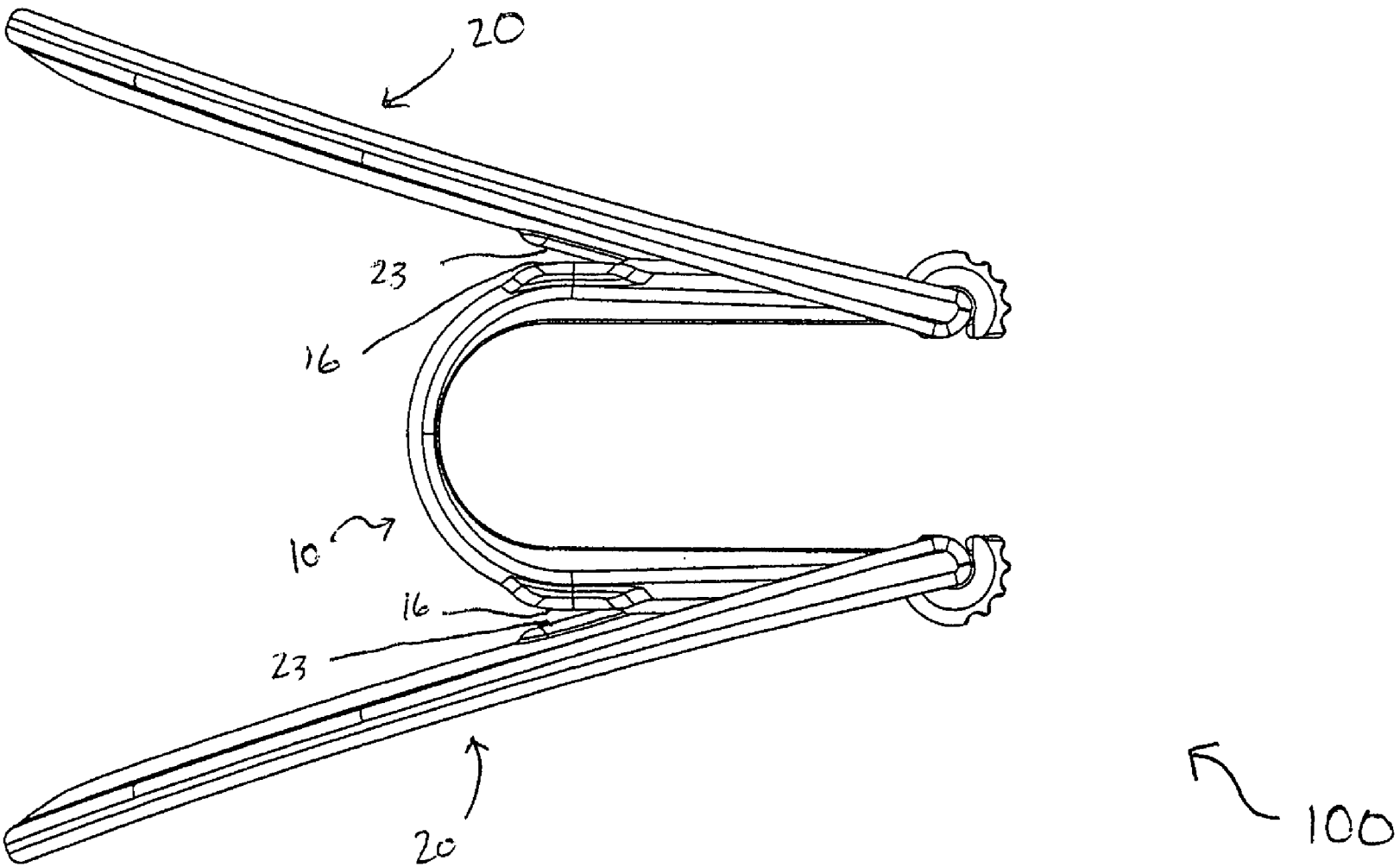
FIG. 20 is a top view of the preferred embodiment shown in FIG. 1, where the non-metallic arms are pivoted back, pressure has been applied to them (not shown), and the non-metallic clip is completely open, the bottom view of this configuration being a mirror image. In practice, the non-metallic arms would be bent if the force required to place the clip in its completely open position were placed near the ends of the arms farthest from the clip.
Figure 21:
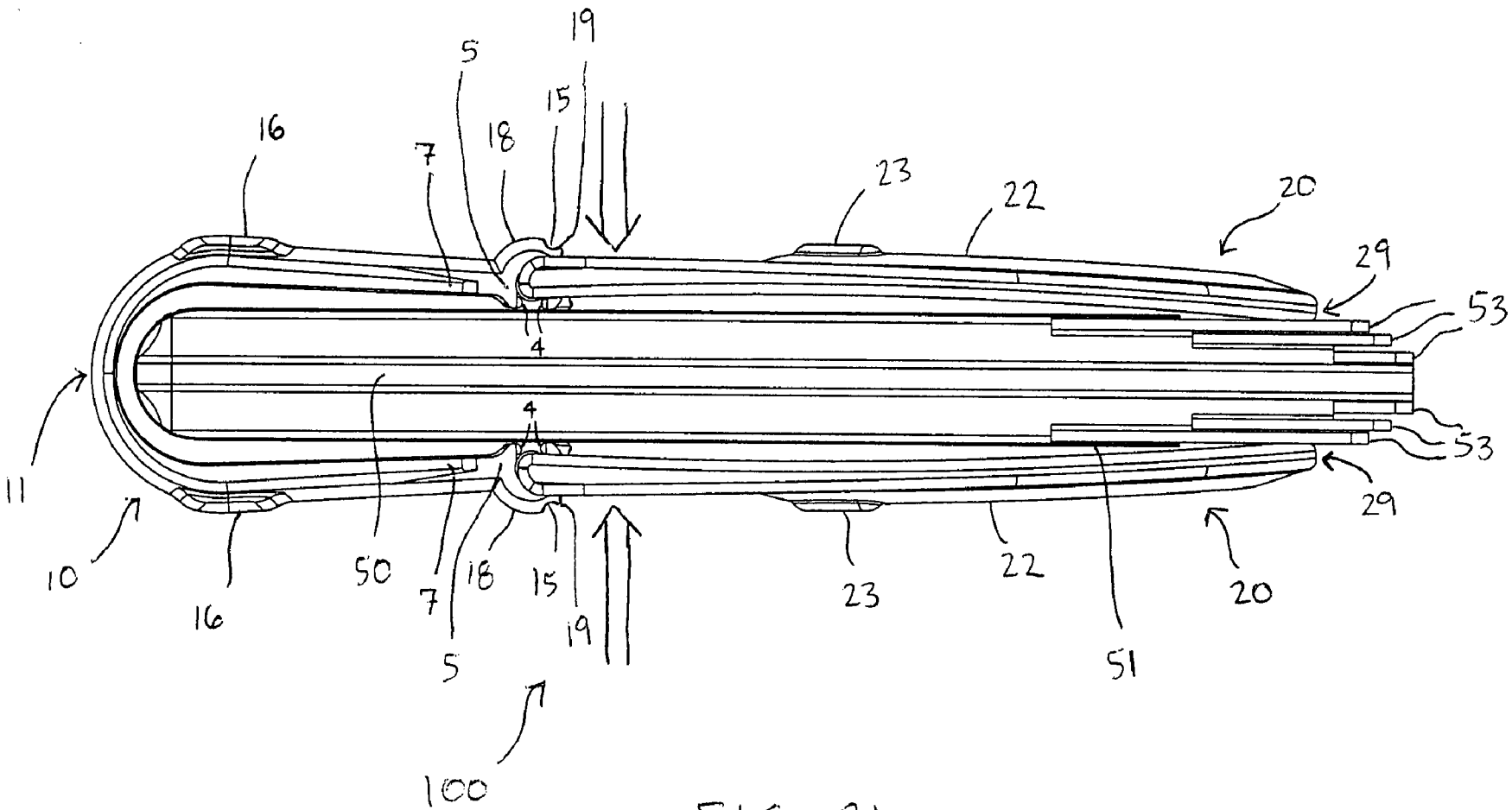
FIG. 21 is a top view of the preferred embodiment shown in FIG. 1, showing that it can include a wallet.

FIGS. 1-20 all show aspects of features of a preferred embodiment of the present devices. FIG. 21 shows that the device depicted in FIGS. 1-20 may include a wallet.

Device 100 is a preferred embodiment of the present devices that includes a non-metallic (e.g., plastic) clip 10 having two ends 14 and a clip leverage bump 16. More specifically, non-metallic clip 10 includes two clip leverage bumps 16 (only one of which is visible in FIG. 1). Clip 10 also includes an inner surface 32 that is shown, for example, in FIGS. 6, 7 and 11.

Device 100 also includes a non-metallic arm 20 that is pivotally coupled to each end 14. As shown in FIG. 20 and described below, one of the arms of device 100 contacts a leverage bump when the clip is completely opened. More specifically, each arm 20 will contact a leverage bump 16 when clip 10 is completely opened. Arms 20 are examples of non-wire frame arms. In contrast, the following patents disclose only arms with wire frames: U.S. Pat. Nos. D321,209; D321,210; 1,139,627; 1,150,073; 4,332,060; 4,402,530; 4,532,680; 4,761,862; 5,249,336 (shows wire frame covered with a sleeve); U.S. Pat. Nos. 5,533,236; 5,896,624; and 6,327,749.

Clip 10 may be characterized as a clip that is not substantially triangular in shape when in an empty (nothing in it) closed position, as shown for example in FIGS. 1-6. In contrast, the following patents disclose only clips that are substantially triangular in shape when in an empty closed position: U.S. Pat. Nos. D321,209; D321,210; D372,498; D485,780; 1,139,627; 1,150,073; 4,332,060; 4,402,530; 4,532,680; 4,761,862; 5,249,336; 5,533,236; 5,896,624; 6,327,749; and 6,745,805. More specifically, clip 10 is an example of a clip that does not have a substantially triangular side profile when in an empty closed position, in contrast to the fifteen patents referenced in the preceding sentence.

Figure 6:
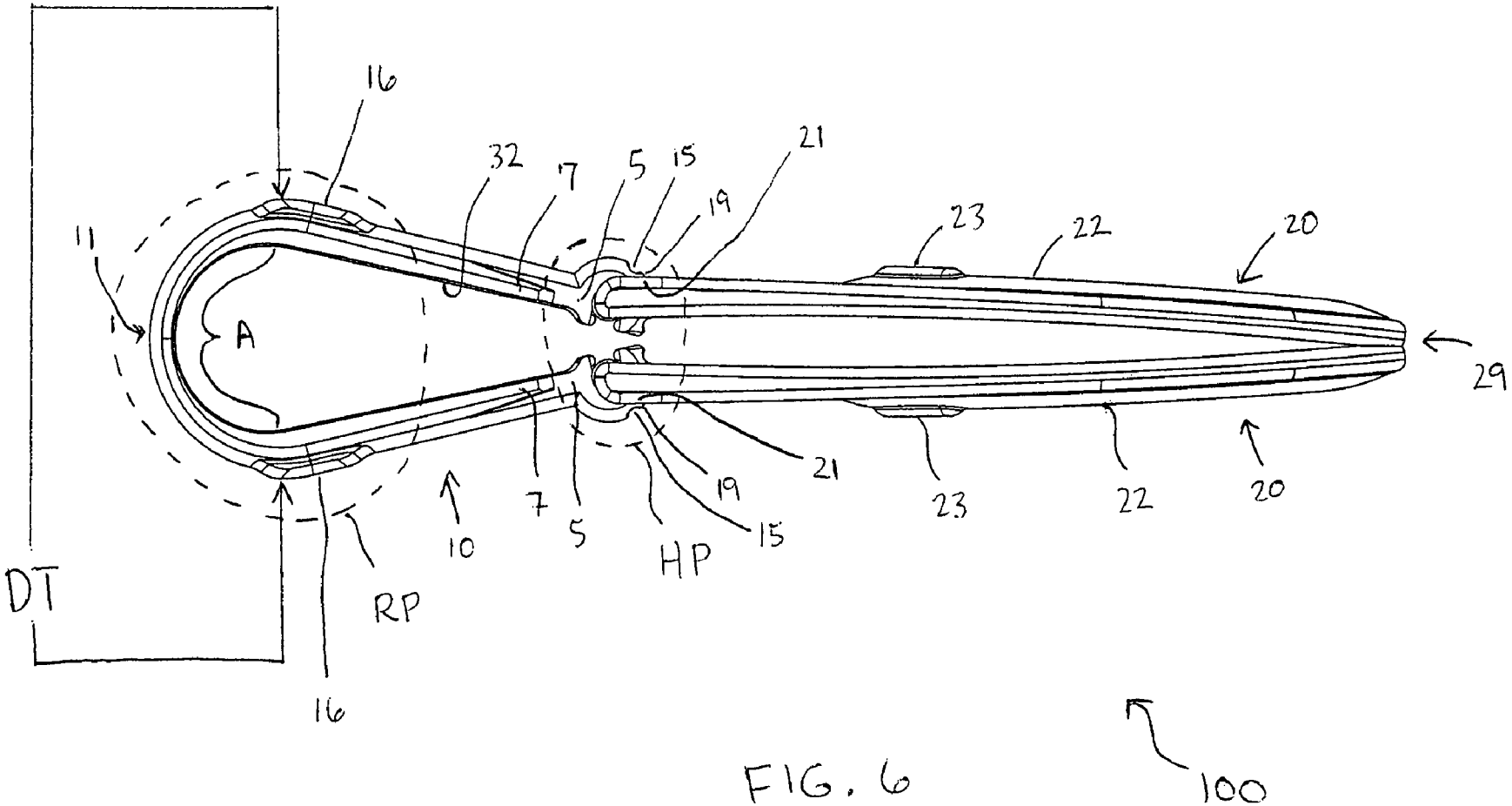
FIG. 6 is a top view of the preferred embodiment shown in FIG. 1, the bottom view being a mirror image.
Figure 7:
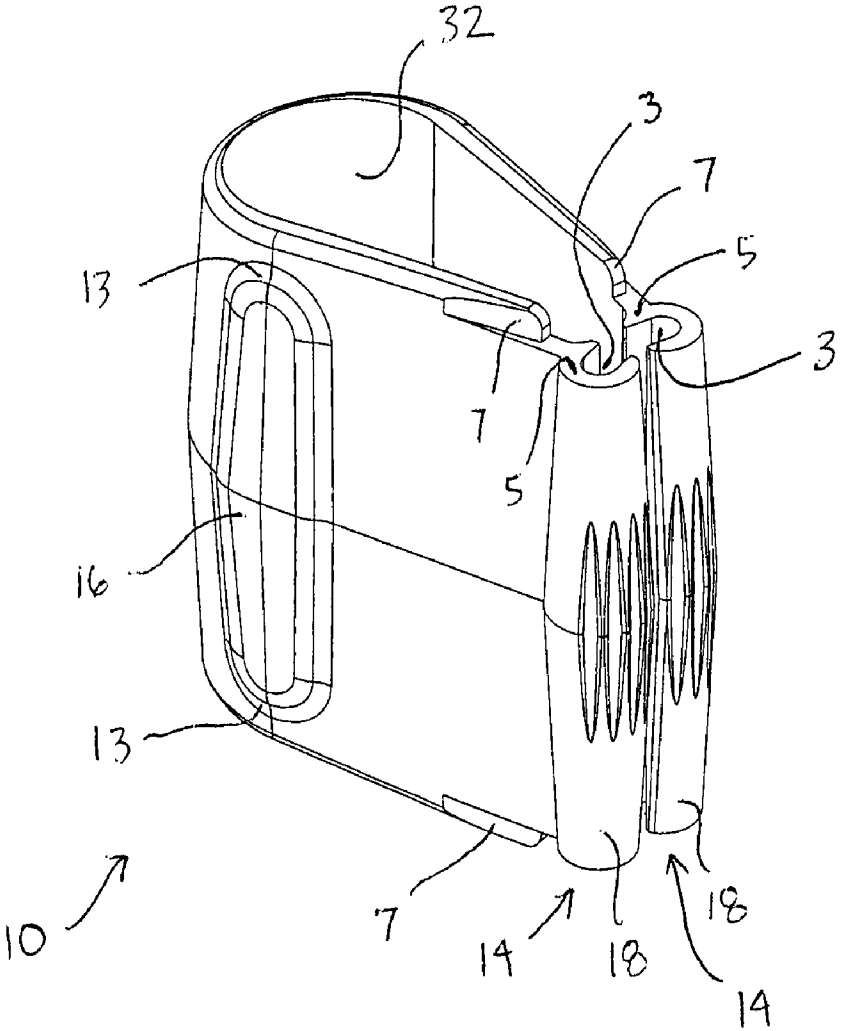
FIG. 7 is a perspective view of the non-metallic clip of the preferred embodiment shown in FIG. 1.
Figure 8:
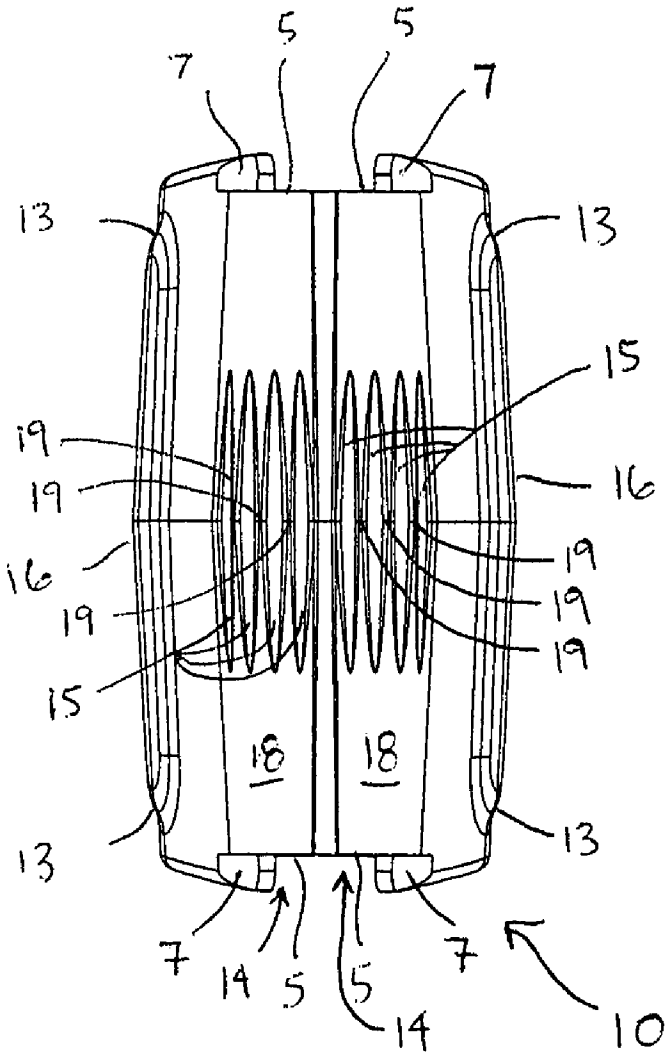
FIG. 8 is a front end view of the non-metallic clip of the preferred embodiment shown in FIG. 1.
Figure 9:
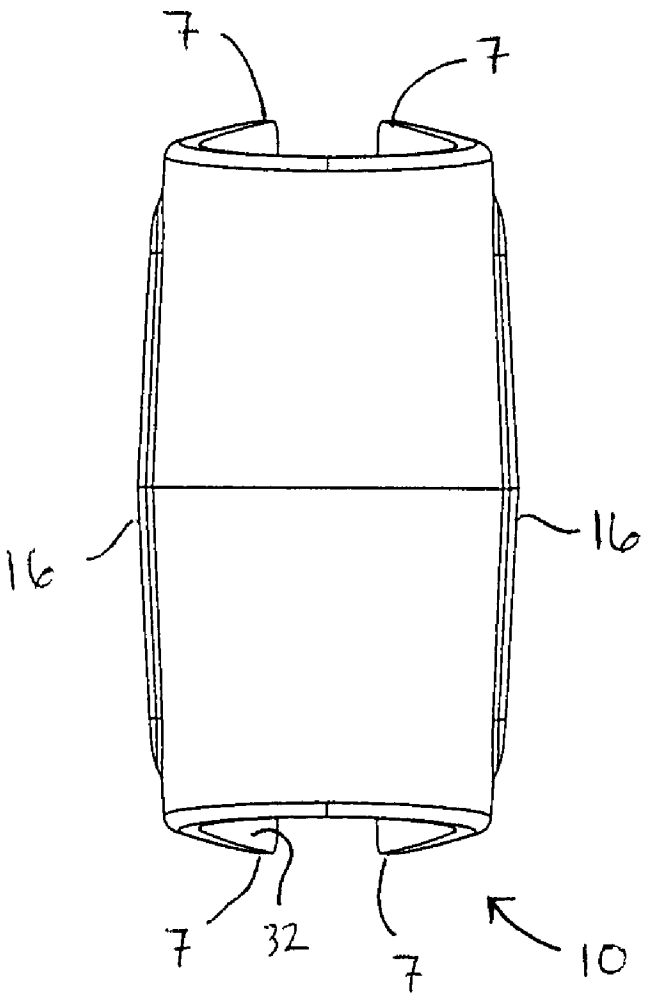
FIG. 9 is a rear end view of the non-metallic clip of the preferred embodiment shown in FIG. 1.

Clip 10 of device 100 in may also be characterized as a spring because it may be configured such that it (a) is biased to a substantially closed position (in which ends 14 are close together but not necessarily touching, as shown in FIG. 6) when no external force is acting on it, (b) can be opened by pivoting back the arms (which may also be characterized as leverage arms) and using force to leverage ends 14 of the clip apart, and (c) can return to a substantially closed position (although perhaps not always the precisely the same position it was in prior to the opening) after the force is removed.

Figure 1:
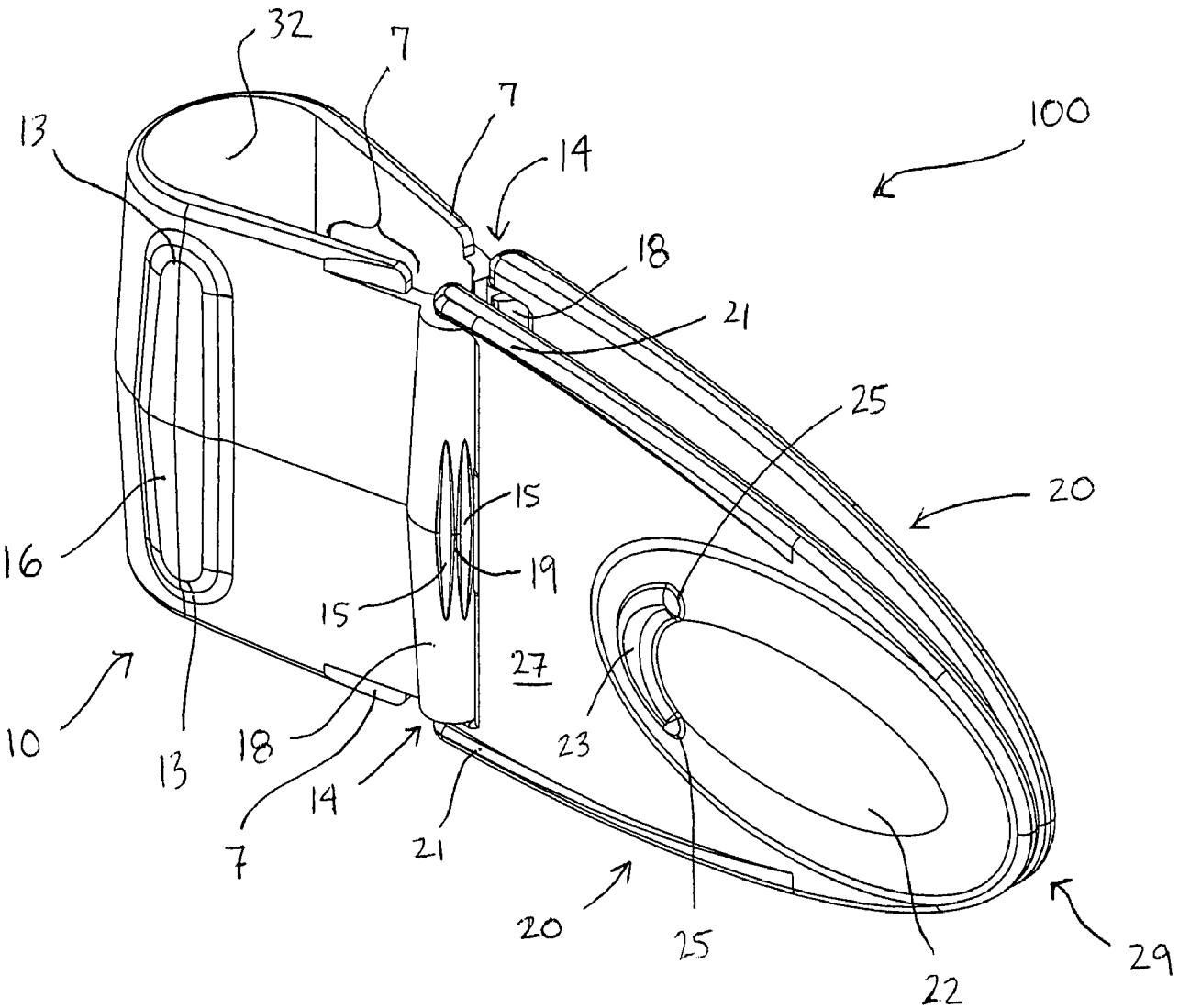
FIG. 1 is a perspective view of a preferred embodiment of one of the present devices, the preferred embodiment being shown in an empty, closed position.

Each end 14 of non-metallic clip 10 of the preferred embodiment shown in the figures includes a pivot shaft retainer 18. Each arm 20 includes a pivot shaft 17 that fits at least partially within a pivot shaft retainer 18. In the depicted preferred embodiment, each pivot shaft retainer 18 includes an outer surface that is defined at least in part by one or more ridges 19. One or more valleys 15 may be positioned on either side of a given ridge 19. As shown in the figures, ridges 19 need not span the entire length (the distance between flat portions 5) of pivot shaft retainer 18. Furthermore, the height of each ridge 19 may be greatest at or near the middle of the ridge (and, therefore, the middle of clip 10). In FIG. 1, for example, the middle of a given ridge 19 is located near the tangent line cutting transversely across the visible ridges.

Each ridge acts (at least during the initial part of the usable life of the device) as an arm-movement inhibitor. A ridge can be configured with a sufficient height such that the portion of each arm nearest the ridge actually contacts the ridge as it pivots past it under force. More specifically, a ridge can be configured with a sufficient height such that force (other than gravity, as is always the case when force is discussed in this application) is required to pivot an arm past it; without such force, the ridge gets in the way, and the arm will not pivot past it. The ridges can be provided and configured in this manner to prevent arms from flapping or pivoting loosely, or to reduce that possibility. A ridge can also be configured with a sufficient height such that once items have been inserted into the clip for capture and the arms have been closed, a user may apply pressure to the portions of the arms near the pivot shaft retainers such that the arms are squeezed together (e.g., pinched) and the edge (discussed in more detail below) of each arm will move past a ridge (such that portions of the arms get closer together) and "snap" into place in a "locked" position from which the edges of the arms will not move back unless exposed to external force. The direction of this pinching force is illustrated with arrows in FIG. 21.

With time, a given ridge may wear down such that it no longer functions in one or more of the above-described manners. Similarly, a given clip may loose its "spring" over time (or may simply break or otherwise plastically deform) such that it can no longer serve its intended purpose of keeping cards, paper and/or a wallet in place.

A given non-metallic arms 20 may be provided with a protrusion 22 on the side facing outwardly (or away) from the device; this outer side is identified by element number 27 in the figures. An indention 24 (see FIG. 14) may be on the opposite side of the arm, and the indention and protrusion may have similar reciprocal shapes. Indention 24 may be characterized as being provided on a side of a given non-metallic arm 20 that will be nearer than any other side of non-metallic arm 20 to an item or items that device 10 holds when non-metallic arms 20 are in a closed position (around the item or items).

As the figures show, a leverage bump 23 (which may be characterized as an "arm leverage bump") may protrude from each protrusion 22. Each leverage bump 23 may be positioned on arm 20 so as to contact a clip leverage bump 16 when the clip is forced into a completely open position (FIG. 20). In those embodiments where an arm leverage bump is positioned to contact a clip leverage bump during opening of the clip, wear points on the arm and clip will include those bumps, though not necessarily exclusively those bumps.

The present clip and arm leverage bumps may be formed by placing extra material on a clip or arm that has already been created and attaching that material to the clip in any suitable fashion, such as through the use of an adhesive, heat, pressure, or any suitable combination of these. Alternatively, the present clip and arm leverage bumps may be created with the clips and arms as they are originally formed.

A version of a suitable clip leverage bump is shown as being provided on each side of clip 10 in many of the figures. Each clip leverage bump 16 spans a majority of the width of clip 10, has U-shaped ends 13, and is widest at or near the middle of clip 10. Other shapes of clip leverage bumps are suitable, such as one that does not span a majority of the width of clip 10 or that is not widest at or near the middle of clip 10. A given clip may have a leverage bump on one side that is different in shape from the clip leverage bump on the other side. Furthermore, each side of a clip may have more than one clip leverage bump.

A version of a suitable arm leverage bump is shown in many of the figures. Each arm leverage bump 23 extends from the middle of arm 20 in a curved manner toward the top and bottom of arm 20. Arm leverage bumps 23 are generally U-shaped and have U-shaped ends 25. Other shapes of arm leverage bumps are suitable, such as one that is not generally U-shaped. A given device may have arms that have differently shaped arm leverage bumps. Furthermore, each arm may have more than one arm leverage bump.

Figure 2:
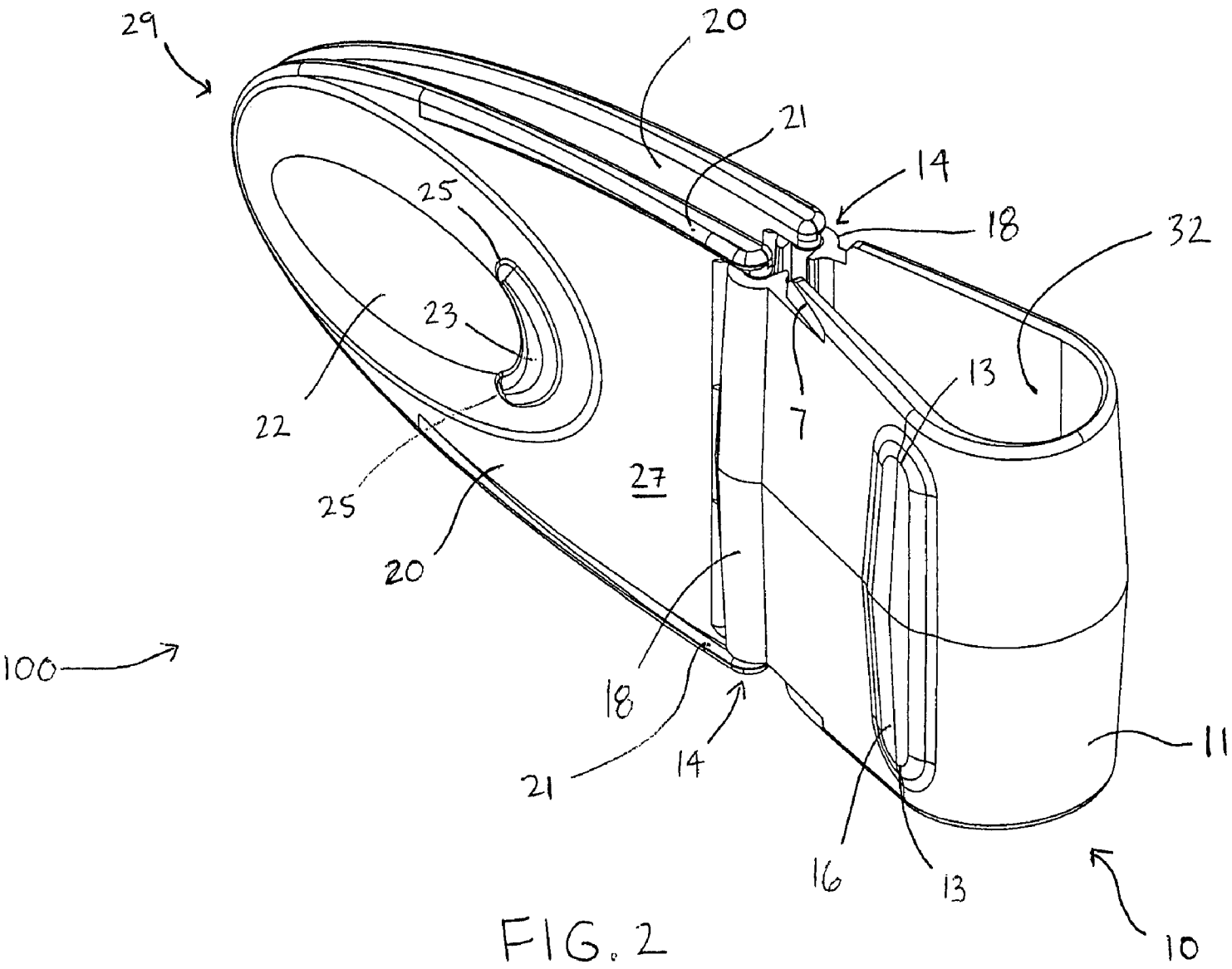
FIG. 2 is another perspective view of the preferred embodiment shown in FIG. 1.
Figure 10:
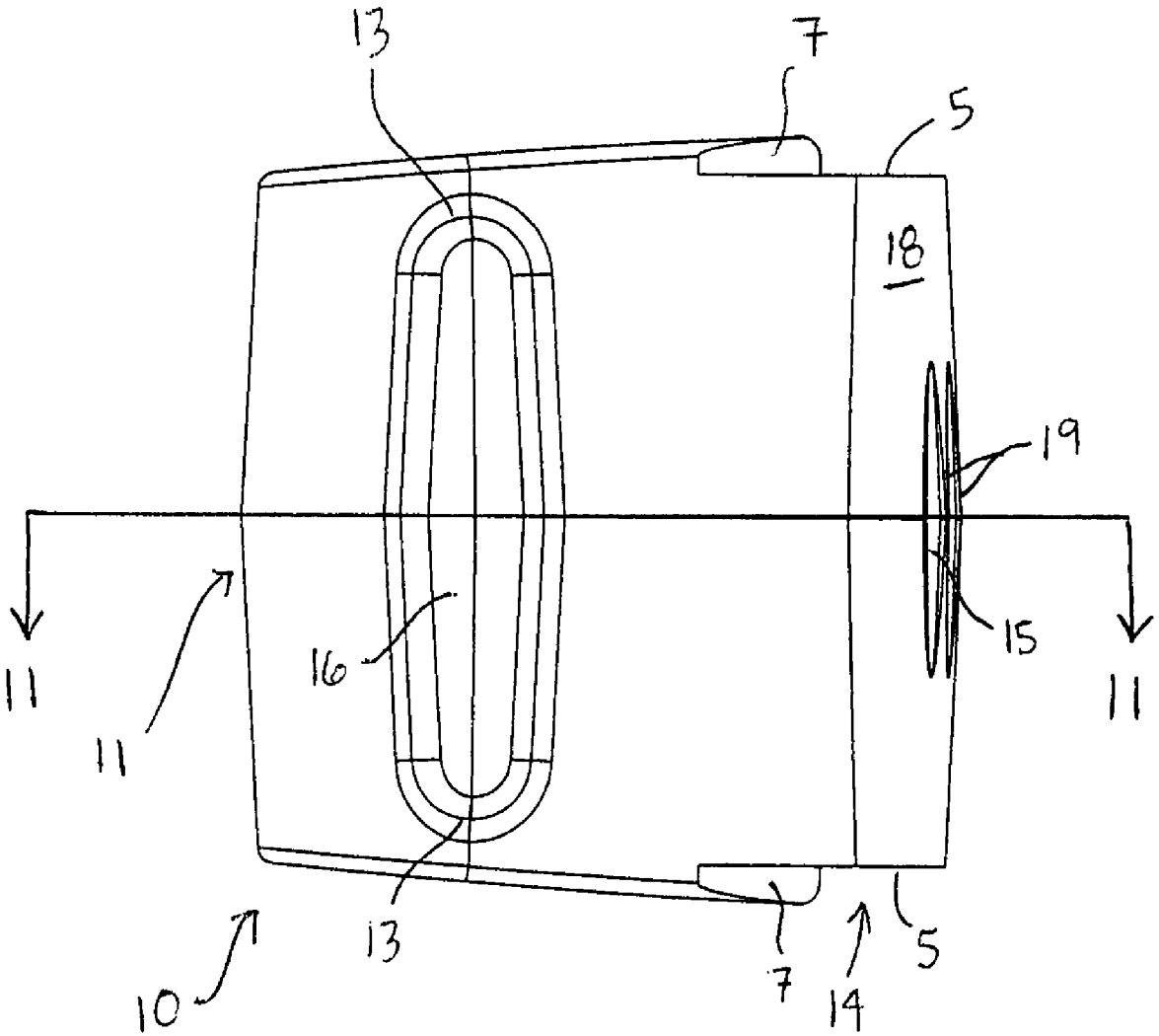
FIG. 10 is a left side view of the non-metallic clip of the preferred embodiment shown in FIG. 1, the right side view being a mirror image.
Figure 11:
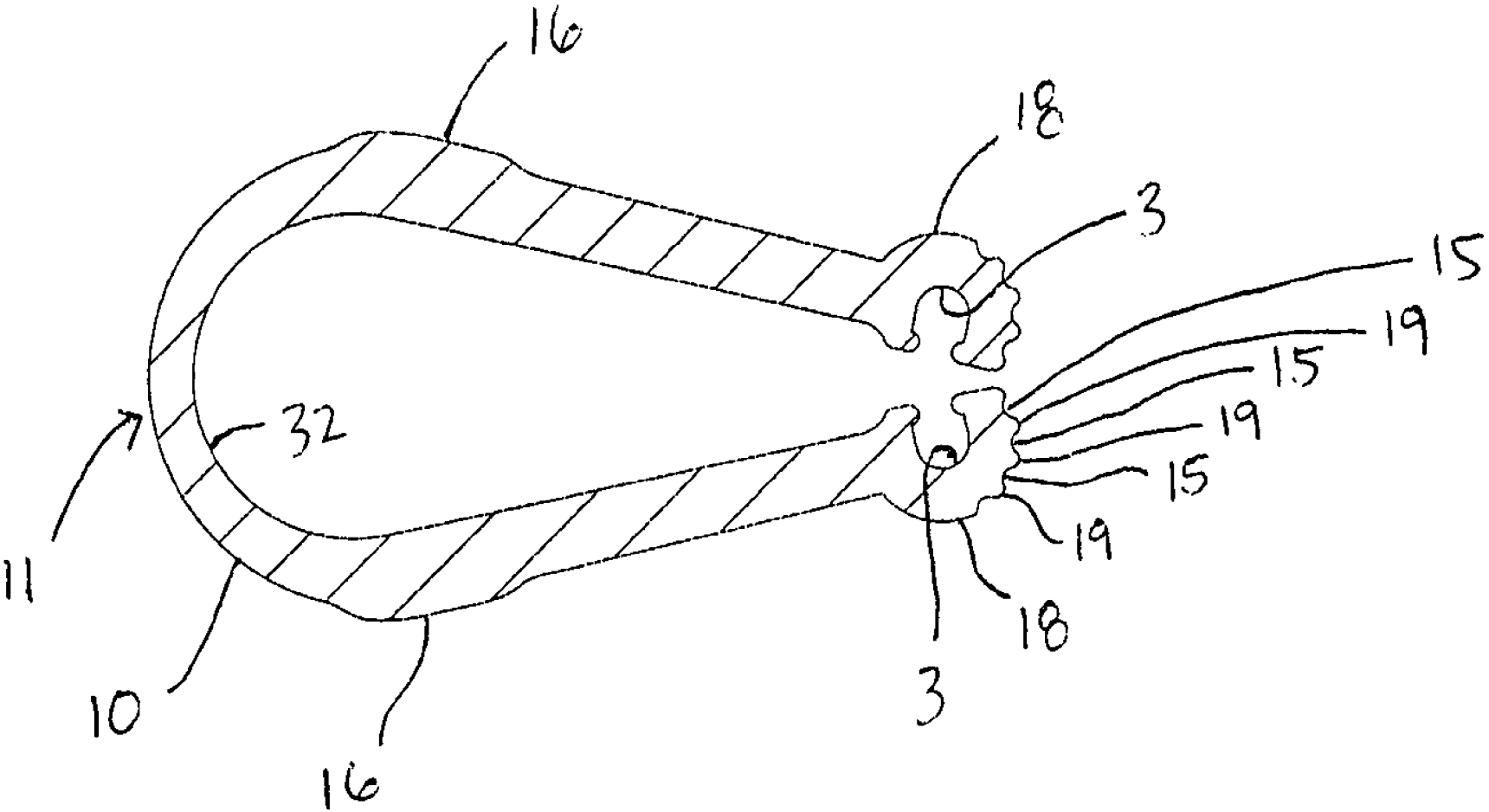
FIG. 11 is a cross-sectional view of the non-metallic clip of the preferred embodiment shown in FIG. 1 taken along lines 11-11 in FIG. 10.
Figure 12:
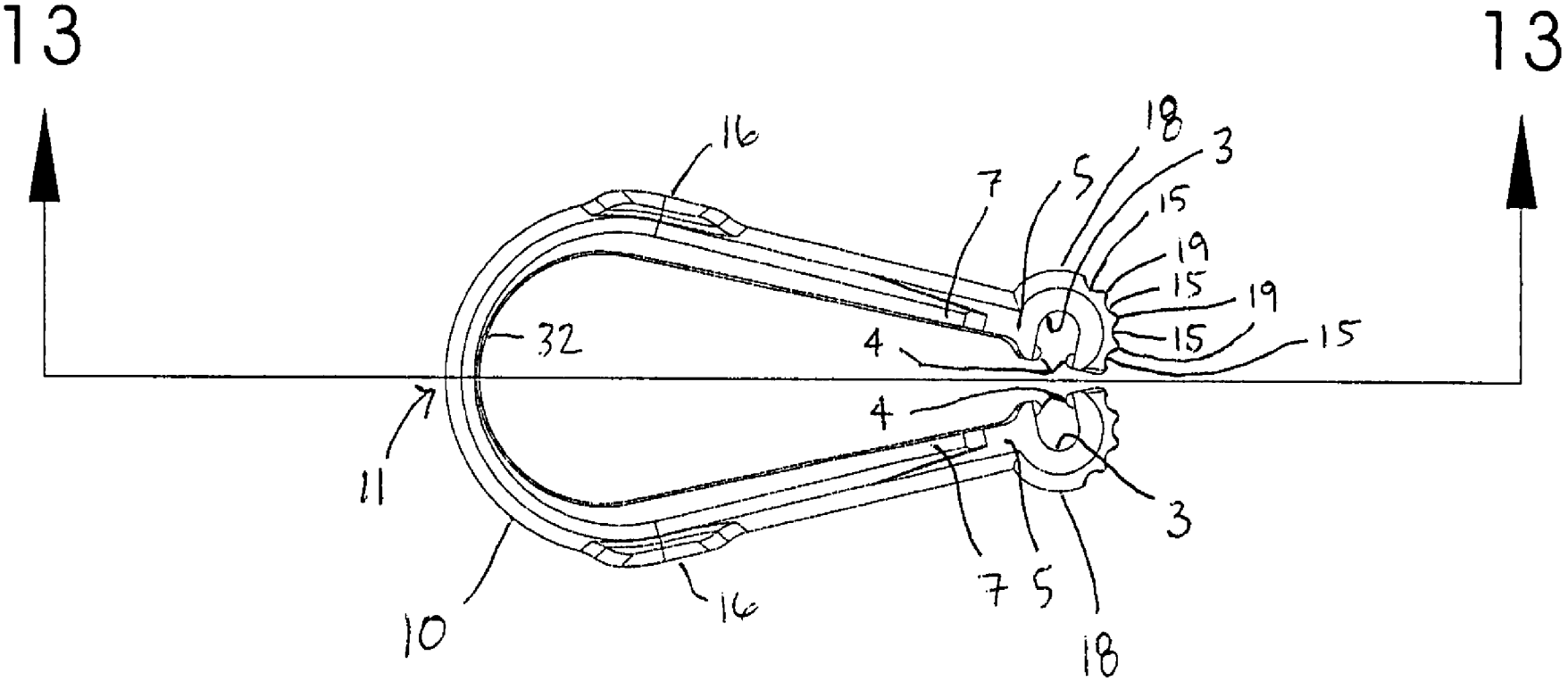
FIG. 12 is a top view of the non-metallic clip of the preferred embodiment shown in FIG. 1, the bottom view being a mirror image.
Figure 13:
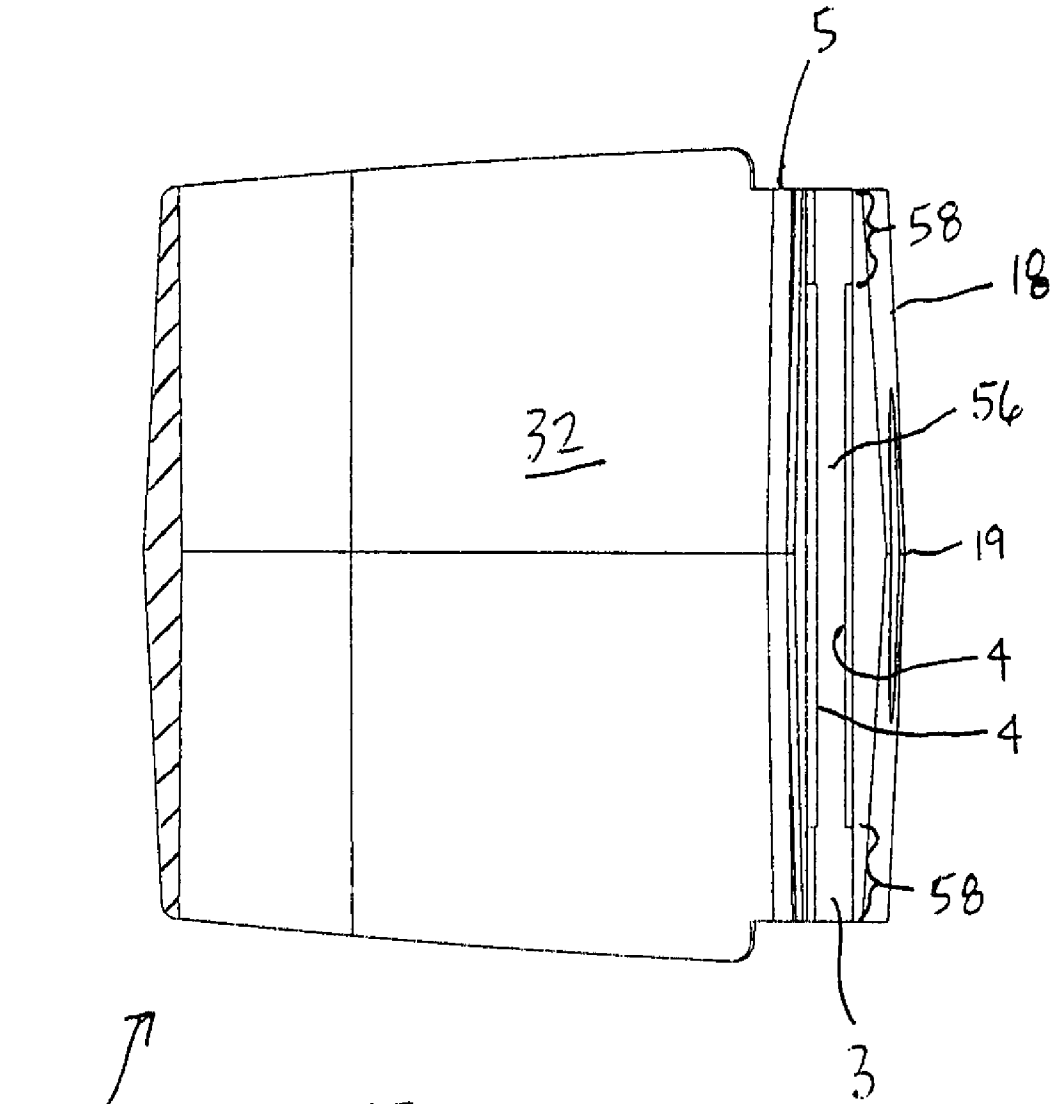
FIG. 13 is a partial cross-sectional view of the non-metallic clip of the preferred embodiment shown in FIG. 1 taken along lines 13-13 in FIG. 12.

Certain figures also show that each half of clip 10 may have two pre-leverage bump extensions 7 located at the top and bottom of the clip near the ends 14 (and, thus, the pivot shaft retainers 18) of the clip. Pre-leverage bump extensions 7 are named as such because portions of arms 20 contact them—thus helping clip 10 to open—before any other portions of arms 20 contact the clip leverage bumps 16, and because they extend up from flat portions 5 that define the tops and bottoms of ends 14 of clip 10. As FIGS. 1 and 2 show, pre-leverage bump extensions 7 get wider moving from ends 14 toward the back (designated generally by 11) of clip 10. Further, as FIG. 10 shows, pre-leverage bump extensions 7 drop in height moving from ends 14 toward back 11 of clip 10.

Figure 16:
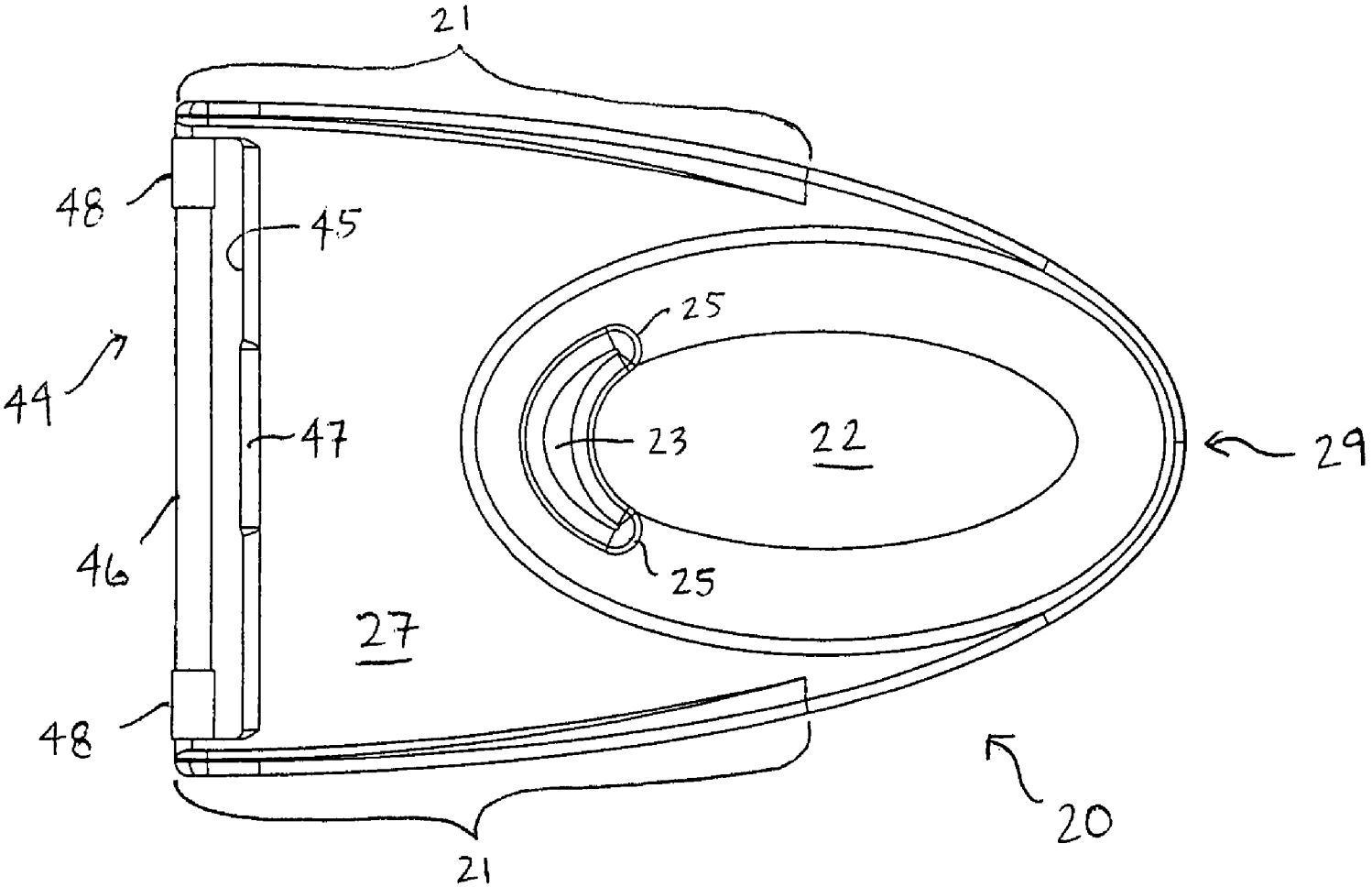
FIG. 16 is a side view showing the outside surface of one of the non-metallic arms of the preferred embodiment shown in FIG. 1.
Figure 17:
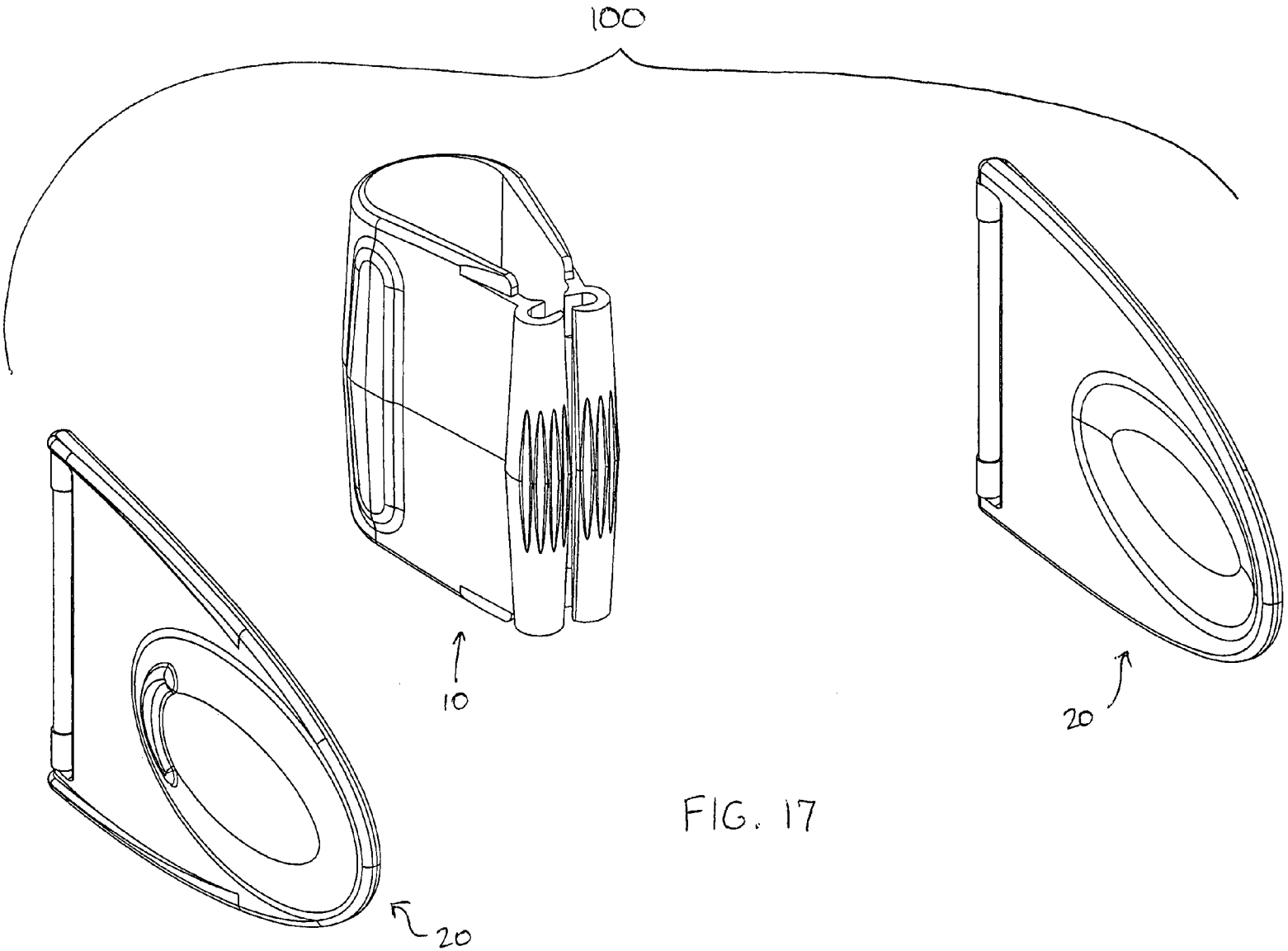
FIG. 17 is a perspective view showing the preferred embodiment shown in FIG. 1 in an exploded, unassembled state.
Figure 18:
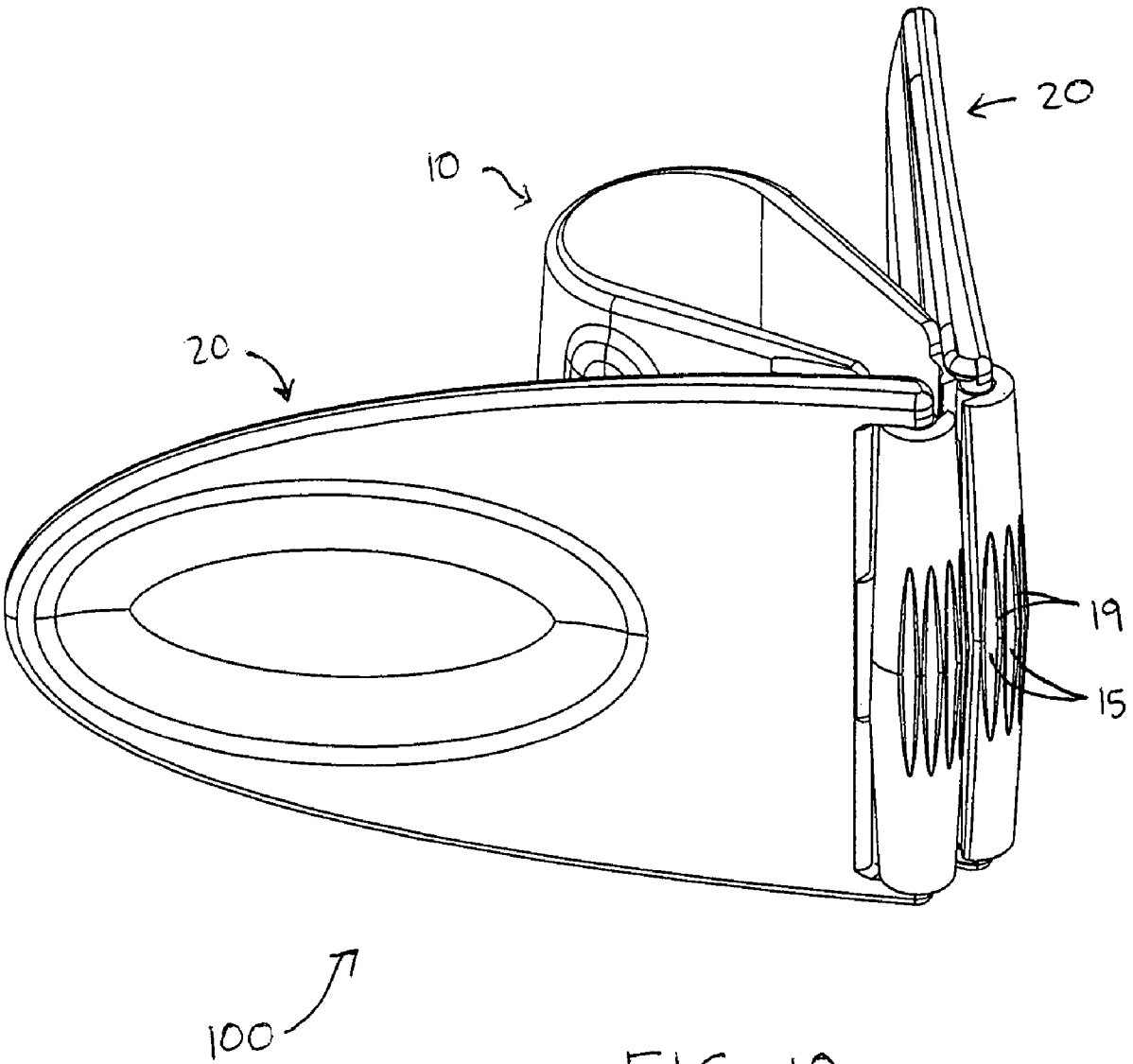
FIG. 18 is a perspective view of the preferred embodiment shown in FIG. 1, where the non-metallic arms are pivoted back in preparation for opening the non-metallic clip.

Certain figures show that arms 20 posses an outer ridge 21 that runs along a portion of the upper and lower edge of each arm. Outer ridges 21 extend outwardly from outer side 27 of each arm 20. This is clear from the views shown in FIGS. 1 and 2, which both illustrate the portion of outer ridges 21 extending outwardly from outer side 27 of each arm as forming a small shelf near the bottom of each view. The outer ridges 27 are widest nearest the pivot shaft retainers 18, and become less wide moving toward the front (designated generally by 29) of arms 20. Outer ridges 27 do not extend inwardly from the inner side of the arms. Outer ridges 27 terminate prior to reaching front 29, as shown in FIG. 16.

Figure 19:
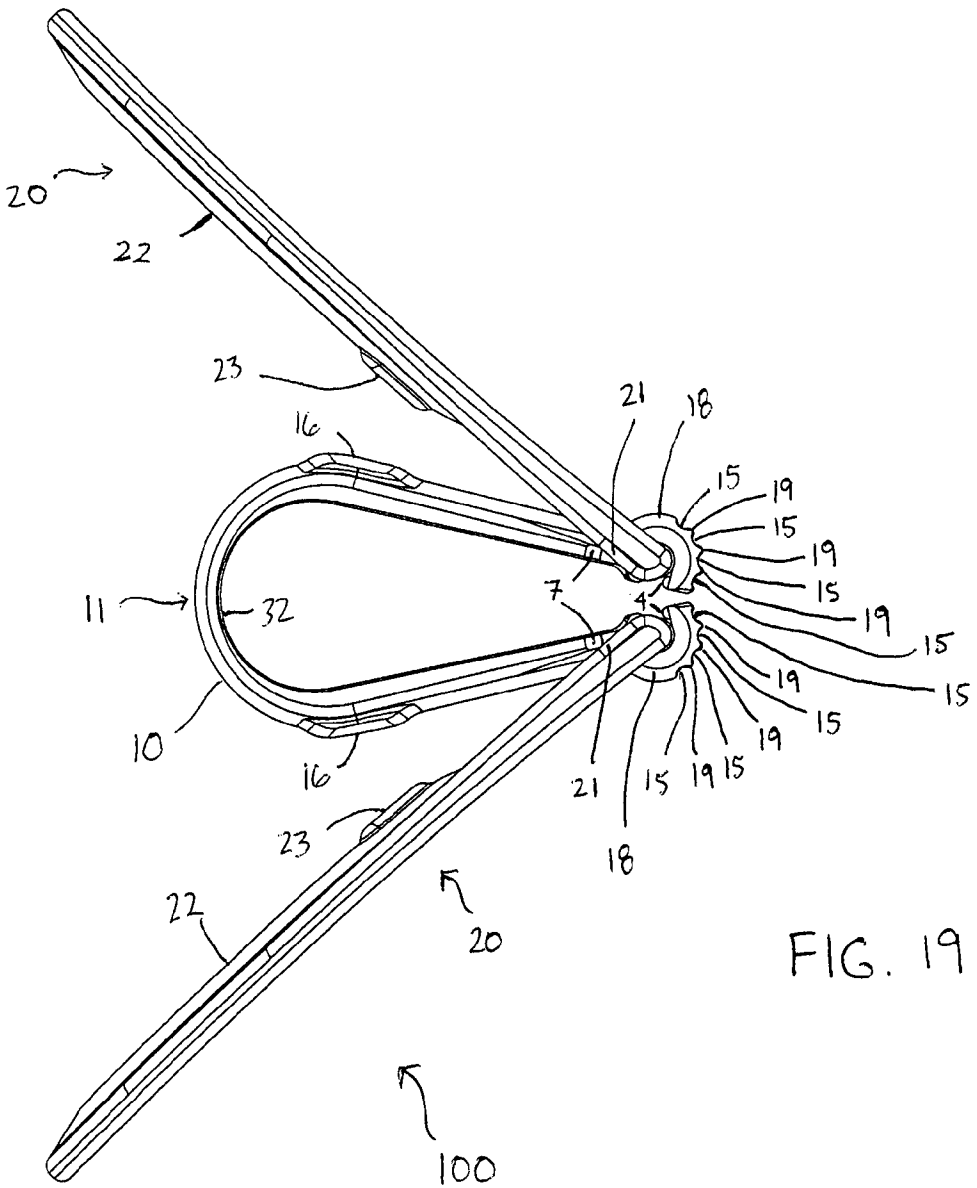
FIG. 19 is a top view of the preferred embodiment shown in FIG. 1, where the non-metallic arms are pivoted back in preparation for a complete opening the non-metallic clip, and where the clip has been opened slightly, the bottom view of this configuration being a mirror image.

During the process of completely opening clip 10, a portion of a given outer ridge 27 contacts a portion of a given pre-leverage bump extension 7 before any other portion of arm 20 contacts a given clip leverage bump 16. This is shown in FIG. 19. This pre-leverage bump contact helps to begin opening clip 20. Furthermore, less force is required to cause that opening than is required to finish completely opening clip 10 once the clip and arm leverage bumps are in contact with one another (or once the arm and clip leverage bumps are in contact with one another, if no arm leverage bumps are provided; or once the arm leverage bumps and rear portion of the clip are in contact with one another, if no clip leverage bumps are provided).

The version of arms 20 shown in the figures are bowed slightly (and, more specifically, bowed inwardly), as shown for example in FIG. 6, such that the inside forward portions of the arms touch when the device is in an empty closed position. The inward bow shown in FIG. 6 may also be characterized as a bend that has taken place around an axis that is perpendicular to the length of the arms. An advantage to having such a bend or bow is that the arms are somewhat easier to pull apart than they would be if they were perfectly straight and lacked such a bow or bend.

Figure 14:
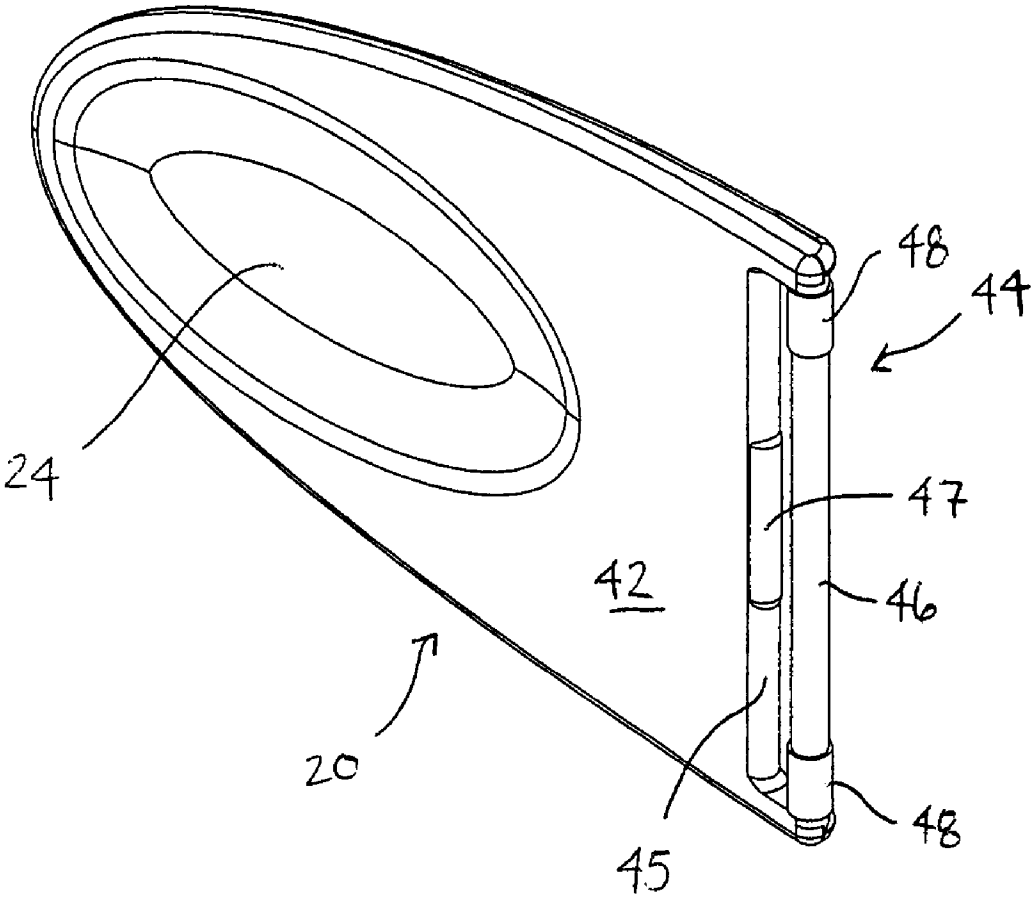
FIG. 14 is a perspective view of the inside surface of one of the non-metallic arms of the preferred embodiment shown in FIG. 1.
Figure 15:
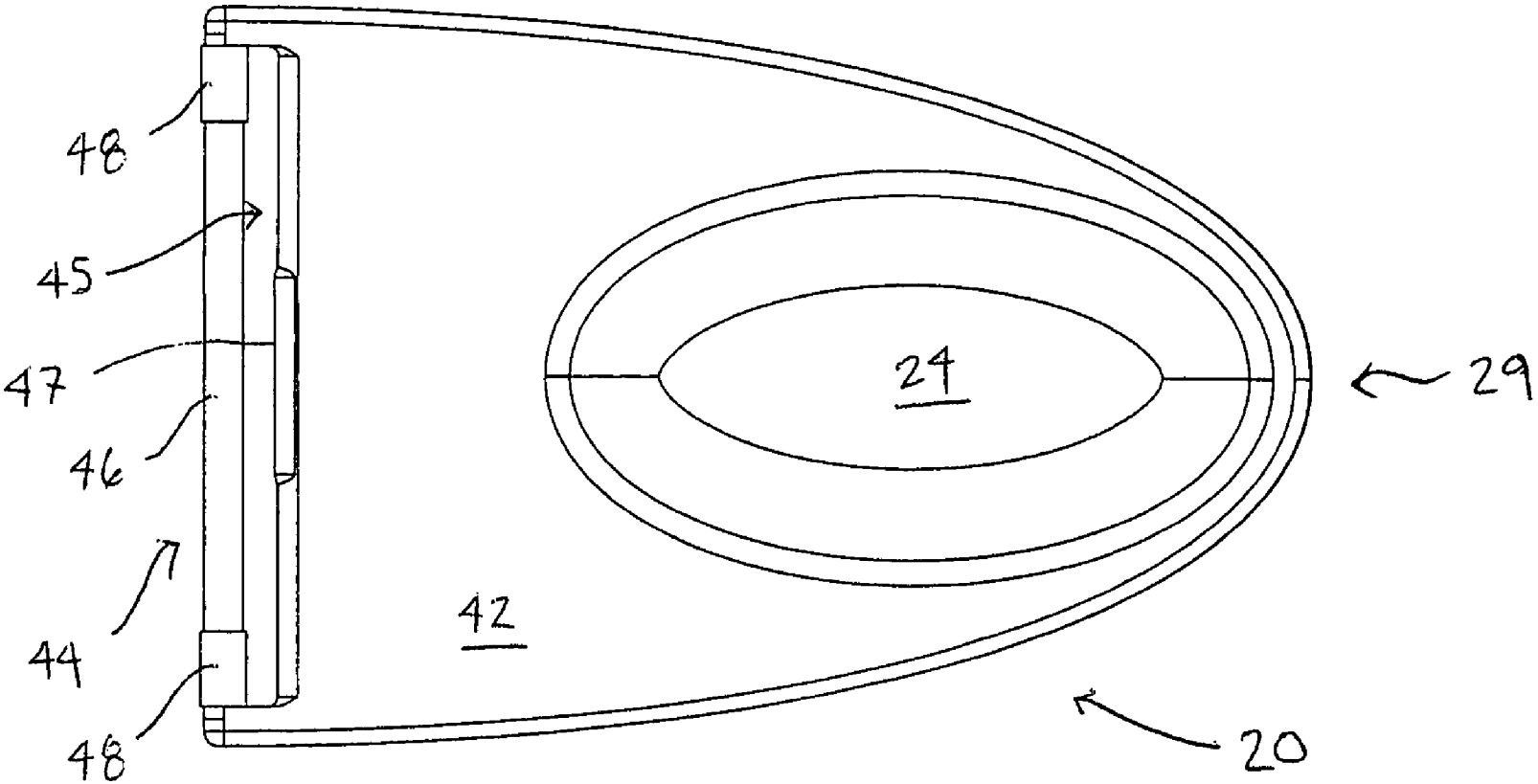
FIG. 15 is a side view showing the inside surface of one of the non-metallic arms of the preferred embodiment shown in FIG. 1.

Turning to features of non-metallic arms 20, FIG. 14 shows inner surface 42 of arm 20. Arms 20 each include a pivot shaft designated generally at 44 around which each arm pivots when device 100 is used. Pivot shaft 44 includes a central portion 46 and two end portions 48. Both the central portion 46 and the end portions 48 of a given pivot shaft 44 are circular in cross-section in the depicted preferred embodiment. However, other shapes may be used, provided they allow the arms to pivot within the portion of the pivot shaft retainer 18 that at least partially encloses or captures them. Central portion 46 of pivot shaft 44 has a smaller diameter than end portions 48. End portions 48 of the depicted preferred embodiment have the same diameter. The height of pivot shaft 44 (which runs in the same direction as the width of arms 20 (see FIG. 3 and corresponding description below)) is substantially equal to the distance between flat portions 5 that define the tops and bottoms of ends 14 of clip 10.

Continuing with arms 20, each arm of the preferred embodiment depicted in the figures includes an edge designated generally by 45 that is spaced apart from and substantially parallel to pivot shaft 44. Edge 45 has substantially the same height/length as pivot shaft 44. Edge 45 is a configured a certain distance from pivot shaft 44 such that a portion of edge 45 (and, thus, edge 45) contacts the ridge or ridges 19 of pivot shaft retainers 18 as arm 20 is pivoted back from a closed position to an open position (such as the completely open position shown in FIG. 20). The range over which arms 20 pivot is greater than 90 degrees but less than 180 degrees in the preferred embodiment depicted in the figures.

The contact that occurs between edge 45 and the ridge or ridges 19 that at least partly define an outer surface of pivot shaft retainer 18 is—in the preferred embodiment shown in the figures—a ratcheting-type contact, at least during the initial stage of the useful life of device 100. As an arm 20 is pivoted back from a closed or substantially closed position to an open position, edge 45 will ratchet past each ridge 19 in the path of its motion, making a clicking sound as it contacts and passes each ridge. If left in a given position that is past a ridge 19, arm 20 will not swing or flop back to its original position without someone forcing it back because the ridge it just passed will be in the way. Edge 45 may be rounded, as in the depicted preferred embodiment, or it may be sharp.

As shown in the figures, edge 45 includes a ridge contact portion 47 that extends nearer to central portion 46 of pivot shaft 44 than the balance of edge 45. In the depicted preferred embodiment, ridge contact portion 47 is the portion of edge 45 that contacts the ridges 19 that at least partly define the outer surface of pivot shaft retainers 18.

Turning to features of the embodiment of clip 10 shown in the figures, a given pivot shaft 44 is at least partially positioned in a corresponding pivot shaft retainer 18 (see, e.g., FIGS. 1 and 2). In the preferred embodiment depicted in the figures, pivot shaft retainer 18 defines a slot or groove 3 that is open at its ends and along its length; thus, groove 3 is open from one flat portion 5 to the other flat portion 5 of a given pivot shaft retainer 18. Slot 3 has upper and lower portions 58 that are slightly larger than end portions 48 of pivot shaft 44. Slot 3 also includes a central portion 56 that is bordered by two elongated, rounded shoulders 4 that tend to close slot 3 somewhat, but not completely; thus, pivot shaft retainer 18 can be characterized as having an open middle portion. Instead, rounded shoulders 4 (which extend between the upper and lower portions 58 of slot 3) narrow slot 3 such that force must be used to snap central portion 46 of pivot shaft 44 into place in slot 3 after the clip and arms are manufactured. That is, in the preferred embodiment depicted in the drawings, the gap between the closest portions of adjacent rounded shoulders 4 is more narrow than the diameter of central portion 46 of pivot shaft 44. With regard to the preferred embodiment shown in the figures, once pivot shaft 44 has been snapped into place, it cannot be removed from slot 3 unless put under force. Further, if the preferred embodiment show in the figures is made from the polycarbonate material described below, it is difficult to remove pivot shaft 44 from a pivotally coupled relationship with pivot shaft retainer 18 (and, thus, slot 3) without damaging or breaking pivot shaft 44. Pivot shaft retainer 18 (and, thus, slot 3) is configured such that pivot shaft 44 has enough "play" within pivot shaft retainer 18 (and, thus, slot 3) to enable arms 20 to be snapped into place and locked around items held by device 100 as described above.

Figure 3:
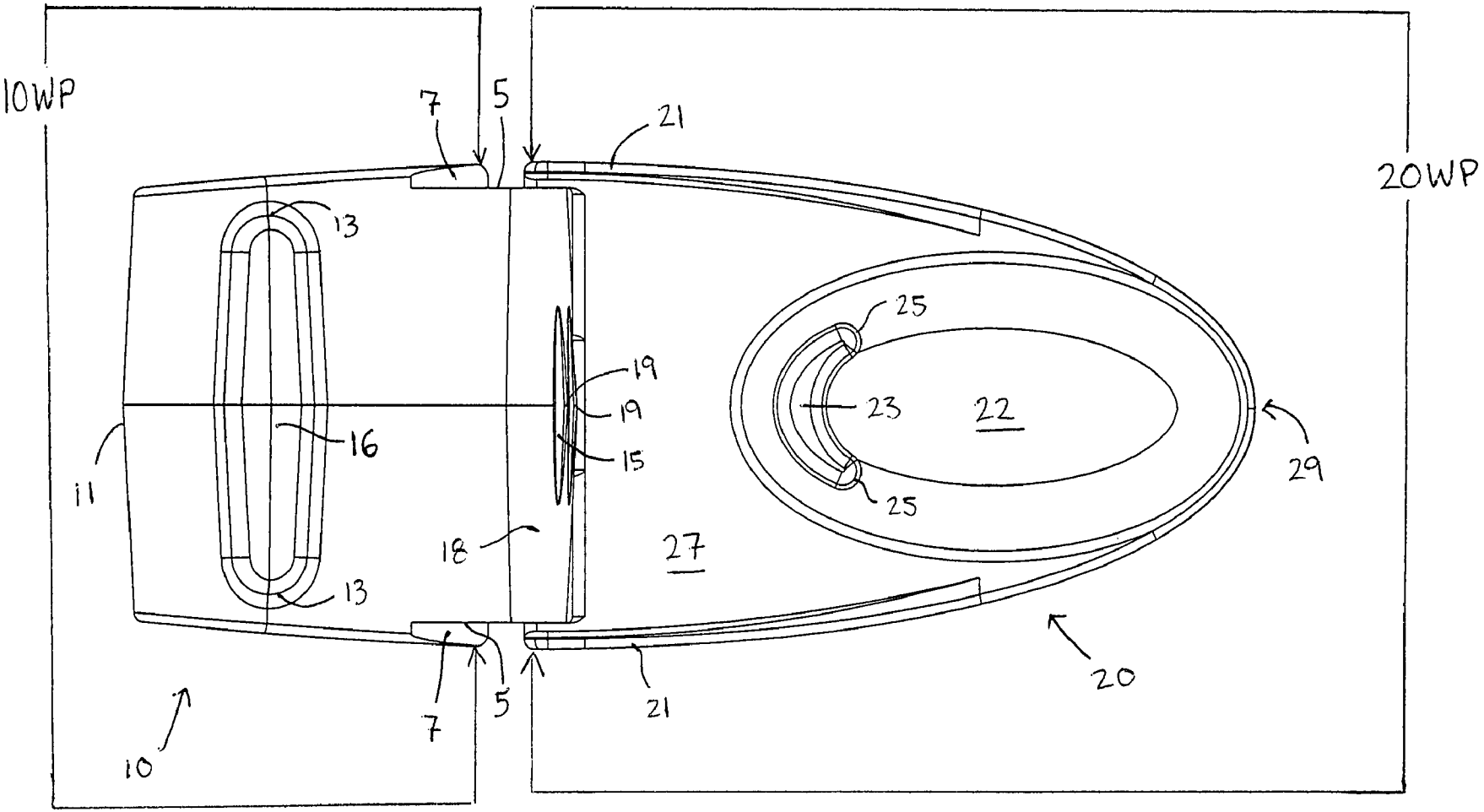
FIG. 3 is a left side view of the preferred embodiment shown in FIG. 1, the right side view being a mirror image.
Figure 4:
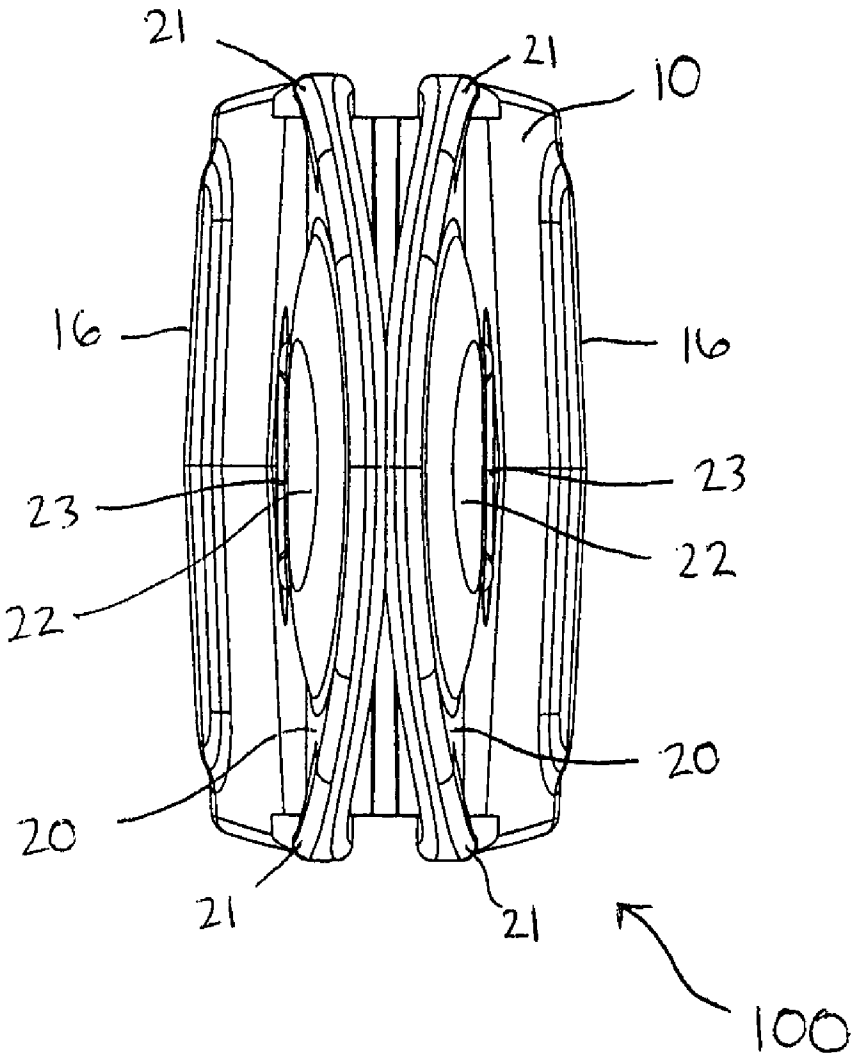
FIG. 4 is a front end view of the preferred embodiment shown in FIG. 1.
Figure 5:
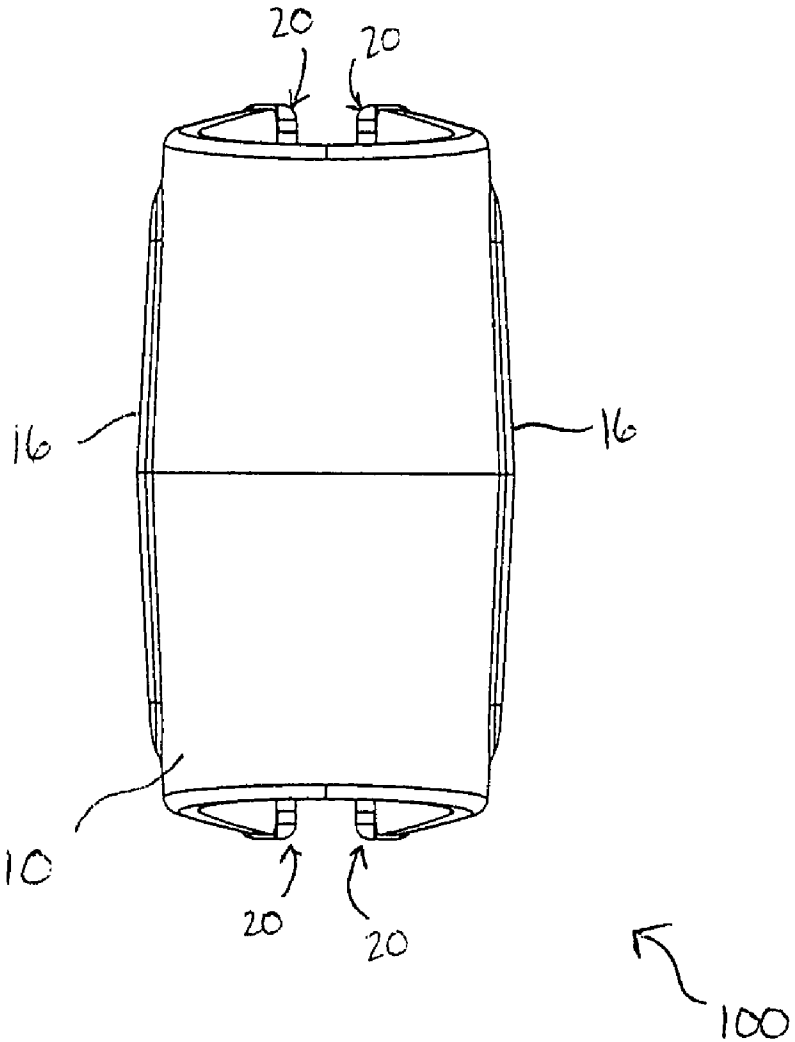
FIG. 5 is a rear end view of the preferred embodiment shown in FIG. 1.

FIG. 3 shows that each non-metallic arm 20 of device 100 has a widest portion 20WP that has substantially the same width as the widest portion 10WP of non-metallic clip 10. Although the widest portions of the present clips and arms may be positioned in different locations along the lengths of those items, FIG. 3 shows that, in the depicted preferred embodiment, widest portion 20WP of each arm 20 is positioned near widest portion 10WP of clip 10.

FIG. 20 illustrates that non-metallic clip 10 is one example of a non-metallic clip that has a completely open position that includes two substantially parallel sides connected by an arch. In contrast, the following patents disclose only clips that lack a completely open position that includes two substantially parallel sides connected by an arch: U.S. Pat. Nos. D321,209; D321,210; D372,498; D485,780; 1,139,627; 1,150,073; 4,332,060; 4,402,530; 4,532,680; 4,761,862; 5,249,336; 5,533,236; 5,896,624; 6,327,749; and 6,745,805. While arms 20 are shown as being straight in FIG. 20, those of ordinary skill in the art will understand that a version of device 10 built using the LEXAN® polycarbonate described below in the relative dimensions shown in the figures will have plastic arms 20 that bend when a user completely opens plastic clip 10 by applying force to each plastic arm 20 near an end (e.g., front 29 of the arms) of each arm.

FIG. 21 is a top view of device 100, and shows that device 100 may include a wallet 50 (which may have one or more pockets) that is effectively held by clip 10, and more specifically holding portion HP of clip 10, which is illustrated in FIG. 6. Holding portion HP of clip 10 may include at least pivot shaft retainers 18 of ends 14. Wallet 50 may have a back end positioned against the inside of clip 10 such that the rear portion of wallet 50 may be described as being received in receiving portion RP of clip 10 (see FIG. 6). FIG. 6 shows that receiving portion RP of clip 10 may include an arch A. Furthermore, clip 10 may be characterized as having an arcuate shaped portion (such as arch A) at one end of the clip, and two pivot shaft retainers 18. FIG. 3 shows that device 100 may have a thickness DT that comprises the greatest distance between the sides of clip 10 (which, in the preferred embodiment, is the distance between clip leverage bumps 16). Paper 51 has been folded around a portion of wallet 50 in FIG. 21. Cards 53 have also been placed in pockets of wallet 50.

The present devices may be sold in any suitable fashion. For example, they may be sold in assembled fashion. Alternatively, they may be sold with the clips and arms separately—the different parts being configured for use with each other, and being configured to be pivotally coupled to each other—such that customers can mix and match different styles or colors of clips with different styles or colors of arms. Furthermore, the present devices may be sold in blister packs or in boxes. The boxes may have a tray in which the device fits (such that the tray has a recess shaped similarly to the device) and/or is strapped.

B. Suitable Materials and Manufacturing Techniques

One suitable non-metallic material from which embodiments of the present non-metallic arms and clips can be made is polycarbonate, which is a polymer and, more specifically, a thermoplastic. One suitable type of polycarbonate is GE Plastics LEXAN® 241R Polycarbonate (North America). This brand of polycarbonate is available from GE Plastics, which has offices in Pleasanton, Pa.; Pittsfield, Mass.; Southfield, Mich.; Seven Hills, Ohio; and Washington, W. Va. The LEXAN® 241R Polycarbonate used may have a flammability rating of UL94 V-0, and F2 UV (ultraviolet) resistance. Thus, the LEXAN® 241R Polycarbonate used may have a flame retardant agent and a UV-resistance filler.

The non-metallic clips and the non-metallic arms may each be made in their own injection mold using traditional injection molding techniques. For example, a 98-ton single extrude injection molding machine may be used to make either non-metallic arms or non-metallic clips. The "injection temperature" of the material may be 270 degrees Celcius. The "injection pressure" may be 75 bar. The molds may be made from 2083H mold steel. Each mold can have two cavities. Each mold can be cooled by water, and the cooling time for a pair of parts (e.g., arms of clips) is 10 seconds.

All aspects of each part (e.g., an arm or a clip) may be made at once by fashioning the injection mold cavities appropriately. After cooling, all parts may be de-molded and cleaned of any flashing or additional plastic. The pivot shafts on the arms may then be snapped into the pivot shaft retainers of the clip to yield a device such as the one shown in the figures.

The greatest dimension of the present devices (e.g., its length; the distance from the back 11 of clip 10 to front 29 of a given arm 20) is less than 6 inches in some embodiments, less than 5½ inches in some embodiments, less than 5 inches in some embodiments, less than 4½ inches in some embodiments, less than 4 inches in some embodiments, less than 3½ inches in some embodiments, and less than 3 inches in some embodiments. The next greatest dimension of the present devices (e.g., its width; the wider of 10WP or 20WP shown in FIG. 3, unless they are equal in width) is less than 3 inches in some embodiments, less than 2½ inches in some embodiments, less than 2 inches in some embodiments, less than 1½ inches in some embodiments, and less than 1 inch in some embodiments. The third greatest dimension of the present devices (e.g., its thickness; DT in FIG. 6, or the greatest distance between sides of a clip) is less than 1½ inches in some embodiments, less than 1¼ inches in some embodiments, less than 1 inch in some embodiments, less than ¾ inches in some embodiments, and less than ½ inch in some embodiments.

All of the devices disclosed and claimed can be made and used without undue experimentation in light of the present disclosure. While the present devices have been illustrated in terms of a preferred embodiment and described in terms of multiple embodiments, it will be apparent to those of ordinary skill in the art that variations may be applied to these devices without departing from the scope of the following claims. For example, the arms of the present devices may be any suitable shape, including hexagonal, or octagonal, as may any of their indention, protrusions, clip leverage bumps and arm leverage bumps. Other non-metallic material may also be used to make the present non-metallic clips and non-metallic arms, such as polyethylene.

The claims are not to be interpreted as including means-plus- or step-plus-function limitations, unless such a limitation is explicitly recited in a given claim using the phrase(s) "means for" or "step for," respectively.

We claim:

1. A device comprising:

a plastic clip having two pivot shaft retainers positioned beside each other, each pivot shaft retainer having two outer open ends and an open middle portion; and a plastic arm having a pivot shaft positioned at least partially in each of the pivot shaft retainers, each pivot shaft having a rotational axis about which that pivot shaft rotates;

where (a) each pivot shaft retainer includes an outer surface defined at least in part by at least one ridge that extends perpendicular to the rotational axis of that pivot shaft to define a height, (b) each plastic arm includes an edge that is spaced apart from that plastic arm's pivot shaft, and (c) the height of each ridge is sufficient to prevent the edge of one of the plastic arms from moving past the ridge as that plastic arm pivots without applying force to that plastic arm.

2. The device of claim 1, where the device is less than 4 inches long, less than 2 inches wide, and less than 1 inch thick.

3. The device of claim 1, where each plastic arm is bowed inwardly such that inner forward portions of the plastic arms touch when the device is in an empty closed position.

4. The device of claim 1, where the plastic arms are configured such that each plastic arm bends when a user completely opens the plastic clip by applying force to each plastic arm near an end of each plastic arm.

5. The device of claim 1, the plastic clip having a clip leverage bump positioned such that one of the plastic arms contacts the clip leverage bump when the plastic clip is completely open.

6. The device of claim 5, the plastic arms and the plastic clip being configured such that, as the plastic clip is completely opened, a portion of a plastic arm contacts the plastic clip before that plastic arm contacts the clip leverage bump.

7. The device of claim 5, the plastic clip having two clip leverage bumps, and each plastic arm contacts a clip leverage bump when the plastic clip is completely open.

8. The device of claim 7, where each plastic arm includes an arm leverage bump that contacts a clip leverage bump when the plastic clip is completely open.

9. The device of claim 1, where each plastic arm has a widest portion and the plastic clip has a widest portion, and the widest portion of each plastic arm and the widest portion of the plastic clip have substantially the same width.

10. The device of claim 9, where the widest portion of each plastic arm is positioned near the widest portion of the plastic clip.

11. The device of claim 1, where each plastic arm includes an indention on a side of the plastic arm that will be nearer than any other side of the plastic arm to an item or items that the device holds when the plastic arms are in a closed position.

12. The device of claim 1, further comprising:

a wallet configured to be held by the clip.

* * * * *